US007549277B2

(12) United States Patent
Brintazzoli

(10) Patent No.: US 7,549,277 B2
(45) **Date of Patent: *Jun. 23, 2009**

(54) BOXING MACHINE

(75) Inventor: Renato Brintazzoli, Bologna (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 130 days.

This patent is subject to a terminal disclaimer.

(21) Appl. No.: 11/100,842

(22) Filed: Apr. 7, 2005

(65) Prior Publication Data

US 2005/0227843 A1 Oct. 13, 2005

(30) Foreign Application Priority Data

Apr. 9, 2004 (IT) ..... BO04A000210

(51) Int. Cl.
*B65B 43/30* (2006.01)
*B65B 5/00* (2006.01)

(52) U.S. Cl. ..... 53/566; 53/504

(58) Field of Classification Search ..... 53/566, 53/574, 284, 504
See application file for complete search history.

(56) References Cited

U.S. PATENT DOCUMENTS 3,242,827 A * 3/1966 Winters ..... 493/315
3,613,525 A 10/1971 Lense et al.
3,956,868 A 5/1976 Ganz et al.
4,109,444 A 8/1978 Lee
4,254,604 A * 3/1981 Vogel et al. ..... 53/566
5,072,573 A * 12/1991 Tisma ..... 53/252
5,249,916 A * 10/1993 Portrait et al. ..... 414/798.9
5,514,068 A * 5/1996 Calvert et al. ..... 493/315
6,446,416 B1 * 9/2002 Kuhn et al. ..... 53/445

FOREIGN PATENT DOCUMENTS

FR 2493805 * 5/1982 ..... 53/566

* cited by examiner

*Primary Examiner*—Rinaldi I. Rada
*Assistant Examiner*—John Paradiso
(74) *Attorney, Agent, or Firm*—William J. Sapone; Coleman Sudol Sapone P.C.

(57) ABSTRACT

In a boxing machine, a conveying and erecting device withdraws one box in an initial flattened configuration. The boxes are arranged with two overlapped layers. The conveying and erecting device gives to the withdrawn box a final erected configuration, in which the box has a parallelogram section. Subsequently, the device transfers the box, at a transferring station, into a pocket of a pocket conveyor. When in use, the pocket has a variable geometry, controlled selectively in the transferring station, to allow the box to be introduced into the pocket.

5 Claims, 3 Drawing Sheets

BOXING MACHINE

BACKGROUND OF THE INVENTION

The present invention relates to a method for conveying and erecting of boxes.

BRIEF DESCRIPTION OF THE PRIOR ART

There are known so-called boxing machines among the machines for packaging products, in particular cosmetic products.

The boxing machine includes an inlet magazine, for housing a pile of tubular boxes, each of which has a plurality of walls defined by pre-weakened folding lines and is in an initial flat blank configuration, in which the box is arranged with two overlapped layers, each of which is defined by two adjacent walls of the box.

The boxing machine includes also a device for withdrawing and transferring the boxes, which has a picking up member, which picks up the boxes, one by one, from the inlet magazine, engages each box on a relative wall, and feeds the boxes, one by one, to a pocket filling conveyor.

The filling conveyor includes two chains, which move in respective planes, substantially parallel to each other, and which have a plurality of pushing elements, extending between the chains, uniformly distributed along the chains, and moved by the chains along a prefixed endless path.

Each pushing element separates two adjacent pockets of the filling conveyor.

Each of the pockets receives and keeps a relative box and its length, measured parallel to the path, approximates by excess to the dimension of a box, likewise measured parallel to the path.

Two lateral guides, connected to the filling conveyor, extend on the opposite sides of the pushing elements to define a boxes feeding channel. A lower guide supports the lower part of the boxes.

Each box reaches, inside a relative pocket, a final erected configuration, in which the box has a parallelogram section and has also a first end open, which is closed immediately, and a second end open, which is first left open, in order to allow the feeding of at least one article into the box.

The needs of the market require various types of boxes, which differ one from another by e.g. dimensions.

The known boxing machines of the above described type present a serious disadvantage deriving from the fact that the adjustment of the position of the pushing elements along the chains, necessary for adapting the length of the pockets to the dimensions of the boxes used each time by the machine, is performed manually, which results in big working difficulties for the staff and relatively long time required for setting up the machine.

SUMMARY OF THE INVENTION

The object of the present invention is to propose a boxing machine, which does not present the above mentioned disadvantages and which is simple and cheap to produce.

A boxing machine proposed by the present invention is obtained in accordance to what is claimed in claim 1, for erecting and filling boxes, each box being erected beginning from an initial flattened configuration, in which the box is arranged in two overlapped layers, each layer of said overlapped layers being defined by at least one wall of the box;

the boxing machine including:

a magazine for containing at least one box;

erecting and filling means, which pick up the box in an initial flattened configuration from the magazine, give to the box a final erected configuration, in which the box has a parallelogram section, and introduce at least one article into the box;

the erecting and filling means including a pocket conveyor having at least one pocket, and a station for transferring the box to the pocket;

with said pocket, in use, having a variable geometry; and with actuating means controlling selectively the geometry of the pocket in the transferring station and allowing the introduction of the box into the pocket independently from the dimensions of the box.

BRIEF DESCRIPTION OF THE DRAWINGS

Now the present invention will be described with reference to the enclosed drawings, showing a non limiting embodiment, in which.

DISCLOSURE OF THE PREFERRED EMBODIMENT

Figure 1:
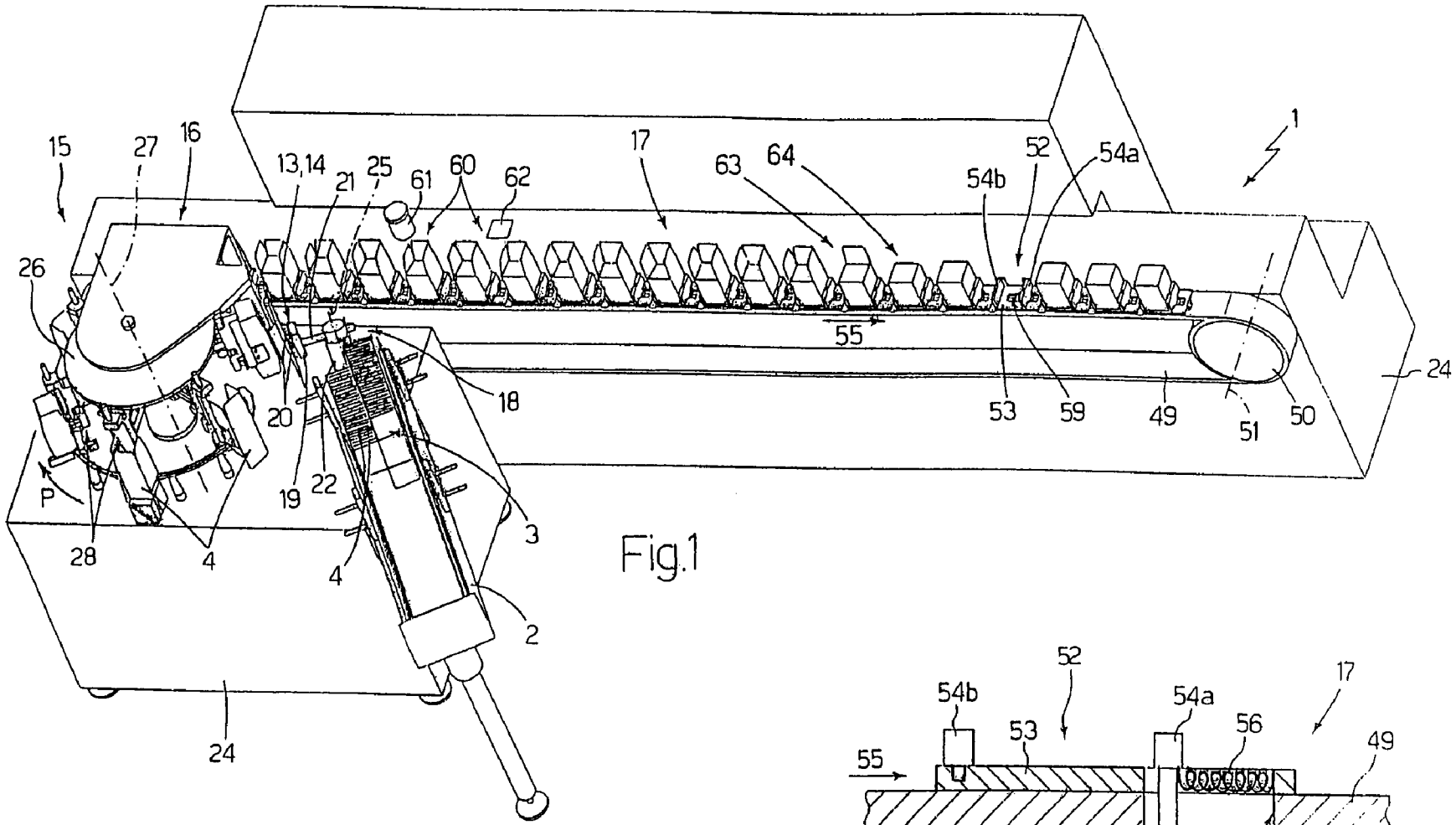
FIG. 1 is a perspective, schematic view, with some parts removed for sake of clarity, of a preferred embodiment of the boxing machine proposed by the present invention.
Figure 5:
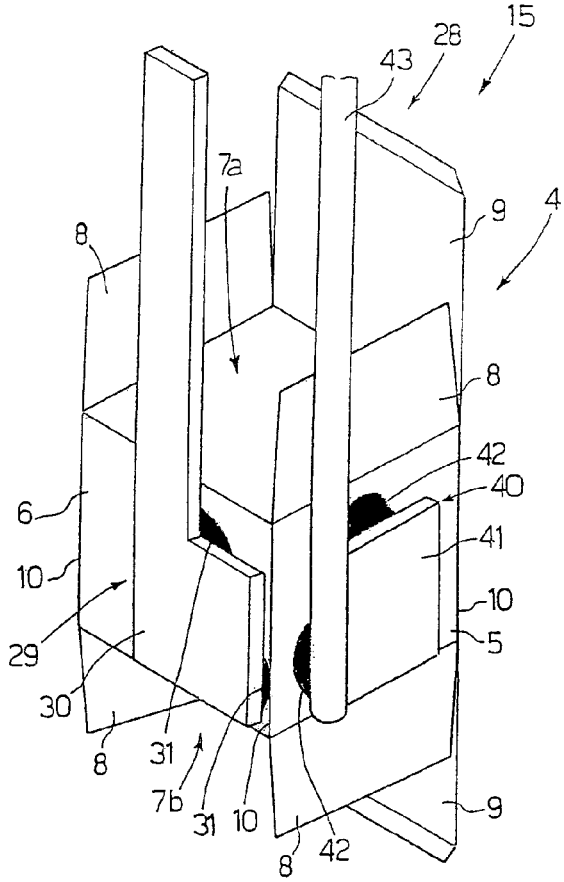

With reference to FIGS. 1 and 5, the reference numeral 1 indicates a boxing machine as a whole, which includes a magazine 2, receiving a pile 3 of tubular boxes 4.

Each of the tubular boxes 4 has, in a final, erected configuration, a parallelogram section defined by a pair of parallel walls 5, a pair of parallel walls 6, perpendicular to the walls 5, and by two open ends 7, each of which is defined, in this case, by two wings 8 connected to the walls 5 and by a flap 9, connected to one of the walls 6.

Each wall 5, 6 is connected to each adjacent wall 6, 5 along a pre-weakened folding line 10 and, likewise, each wing 8 is connected to the relative wall 5 and each flap 9 is connected to the relative wall 6 by further pre-weakened folding lines 10.

Each box 4 is arranged inside the magazine 2 in vertical position, with one of the ends 7 (from now on indicated with 7*a*) situated above the other end 7 (from now on indicated with 7*b*), and in an initial flat configuration, in which the walls 5, 6 are folded to form two overlapped layers 11, 12 (FIG. 4), substantially touching each other.

Each of the layers 11, 12 include two respective walls 5, 6.

According to what has been shown in FIG. 1, the machine 1 includes a withdrawing device 13 for withdrawing the boxes 4, one by one, from the magazine 2, in a loading station 14.

A conveying and erecting device 15 receives, one after the other, the boxes 4 from the device 13 and feeds them along a path P, extending between the station 14 and a station 16, in which the boxes 4 are transferred to a pocket filling conveyor 17.

Then, the conveying and erecting device 15 erects the boxes 4 and closes the relative ends 7*b* during the boxes 4 feeding along the path P.

The device 13 includes a picking up member 18, which comprises a plate 19 equipped with a pair of suction cups 20, connected to a suction device of known type, not shown, and fastened to one end of a slide 21 coupled in known way to a turret 22.

The slide 21 can be oriented to perform straight movements with respect to the turret 22.

The turret 22 is coupled rotatingly to a stationary frame 24 of the machine 1, so that it can rotate with respect to the frame 24 and due to the push of an operating device of known type, not shown, on a rotating axis 25, substantially vertical.

Figure 2:
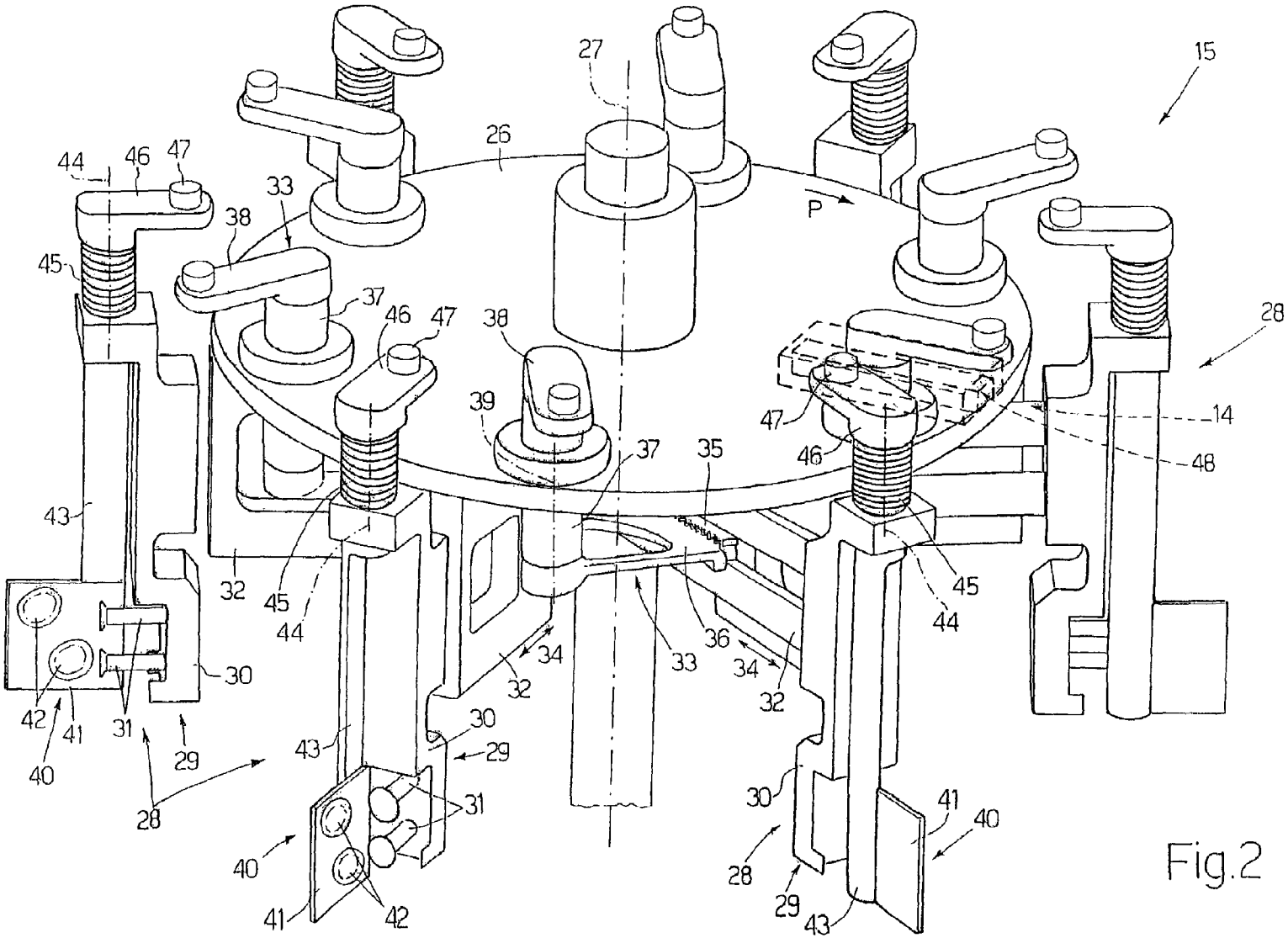
FIG. 2 is a perspective, schematic view, with some parts removed for sake of clarity, of a first detail of FIG. 1.

With reference to FIG. 2, the device 15 includes a drum 26, which is mounted rotating on the frame 24, rotated in steps with respect to the frame 24 due to the push of a known and not shown motor, on an axis 27, parallel to the axis 25.

The drum 26 supports a plurality of conveying and erecting units 28 (in the present case six units 28), regularly distributed along the edge of the drum 26.

Each unit 28 includes a first picking up element 29, comprising a plate 30, which is substantially L-like and which is equipped with a pair of suction cups 31, connected to the suction device (not shown).

The plate 30 is fastened to an end of a slide 32 coupled in known way to the drum 26, in order to perform straight movements, due to the push of an actuator device 33, operated in the stations 14 and 16 and in a relative radial direction 34, between a rear position (FIG. 2) and a withdrawn position (not shown).

The device 33 includes a rack 35, fastened to the slide 32 parallel to the direction 34, and coupled to a toothed section 36, which is integral with a shaft 37, mounted rotating through the drum 26, to oscillate with respect to the drum 26 and due to the push of a linkage 38, shown only partially in FIG. 2, on a rotating axis 39 parallel to the axis 27.

The unit 28 includes also a second picking up element 40, comprising a flat plate 41, which has a pair of suction cups 42 connected to the suction device (not shown), and which is fastened to one end of a shaft 43, mounted rotating through the plate 30, to rotate with respect to the plate 30, on an axis 44, whose fulcrum is parallel to the axis 27.

A torsionally flexible spring 45, set to surround the shaft 43, normally keeps the flat plate 41 in an erecting working position (FIGS. 2 and 5), in which the suction cups 42 are arranged orthogonal to the suction cups 31.

The shaft 43 has an arm 46, which extends toward the outside of the shaft 43 and supports a roller 47, coupled rotating with the arm 46 and engaging, at the station 14 and during the movement of the unit 28 between its rear and withdrawn positions, with a path 48, substantially straight, arranged at an angle different from zero with respect to the direction 34.

The orientation of the path 48 with respect to the direction 34 is such that:

during the movement of the unit 28 from its rear position to its withdrawn position, the shaft 43 is moved clockwise on the axis 44 in FIG. 2, and against the action of the spring 45, so as to arrange the plate 41 in an engaged working position (FIG. 4), in which the suction cups 42 are arranged substantially parallel to the suction cups 31, in order to receive a box 4 from the device 13; and during the movement of the unit 28 from its withdrawn position to its rear position, the tappet roll 47 cooperates with the spring 45, to move the shaft 43 counterclockwise on the axis 44 in FIG. 2 and to arrange the plate 41 again in its erecting working position.

Figure 3:
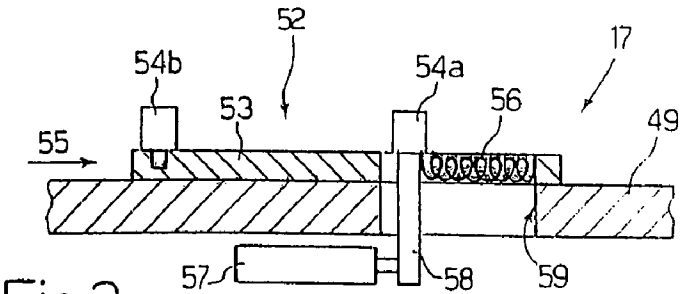
FIG. 3 is a lateral, schematic view, with some parts in section and some parts removed for sake of clarity, of a second particular of FIG. 1; and FIGS. from 4 to 6 are perspective and schematic views of the boxing machine of FIG. 1, in three different working positions.

With reference to FIGS. 1 and 3, the pockets filling conveyor 17 includes a belt 49, which moves in a vertical plane and which is wound endlessly on a pair of pulleys 50, mounted on the frame 24 to rotate with respect to the frame 24 on respective horizontal rotation axes 51, transversal to the axis 27.

One of the pulleys 50 is motorized in steps.

The conveyor 17 includes also a plurality of pockets 52, which are distributed uniformly along the belt 49 and are fed by the belt 49 through the station 16, each in step relation with a relative conveying and erecting unit 28.

Each pocket 52 has a variable width including a flat bottom wall 53 fastened to the belt 49, and a pair of lateral walls 54, which are mounted on the plate 53, orthogonal thereto.

The lateral walls 54 are substantially orthogonal to a direction 55 of pockets 52 feeding and are arranged one (later indicated with 54*a*) before the other (later indicated with 54*b*) in the direction 55.

The wall 54*b* is integral with the wall 53, while the wall 54*a* is coupled slidingly with the wall 53, so as to move with respect to the wall 54*b* in the direction 55, and it is normally kept, by a spring 56 interposed between the walls 53 and 54*a*, in a first working position, in which the distance between the walls 54*a* and 54*b* approximates by defect to the minimum width of a box 4 measured parallel to the path P.

The wall 54*a* is moved, by an actuator 57, against the action of the spring 56 from the first working position to a second working position, in which the distance between the walls 54*a* and 54*b* approximates by excess to the maximum width of a box 4 measured parallel to the path P.

The actuator 57 is mounted in the transferring station 16 and engages a control bar 58, which protrudes from the wall 54*a* and engages slidingly with a slot 59 made through the wall 53 and the belt 49.

Moreover, the actuator 57 moves between a raised position (FIG. 3), in which the bar 58 is operated and a lowered, rest position (not shown), in which the actuator 57 rests below the bar 58, in order to allow the pocket 52 to move forward in the direction 55.

The operation of the machine 1 will be now described with reference to the enclosed figures, taking into consideration the conveying, erecting and filling of only one box 4, and beginning from a moment, in which the picking up member 18 is in a loading position, facing the magazine 2, and in which the conveying and erecting device 15 moves a conveying and erecting unit 28 toward the loading station 14.

The slide 21 is moved through the turret 22 to allow the suction cups 20 first to engage the layer 11 of the box 4 in question and then, to allow the picking up member 18 to withdraw the box 4 from the magazine 2.

Figure 4:
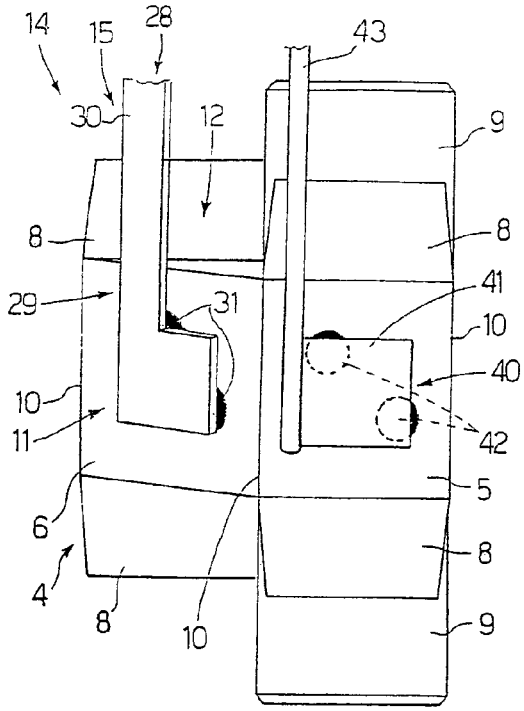

The turret 22 is rotated around the axis 25 to move the member 18 to the transferring position, facing a conveying and erecting unit 28, which reaches its withdrawn position, when the device 15 dwells in the station 14, to allow the roller 47 to engage with the path 48 and to allow the picking up member 40 to reach its engaging working position (FIG. 4).

When the box 4 has been released by the suction cups 20 to the suction cups 31 and 42, the unit 28 is moved again to its rear position.

During the movement of the unit 28 from its withdrawn position to its rear position, the picking up member 40 moves with respect to the picking up member 29 to reach its erecting position and to move the layers 11, 12 away from each other, so as to give to the box 4 its final, erected configuration (FIG. 5).

At this point, the device 15 is operated again to move the unit 28 in an intermittent way along the path P, first through a first closing station (not shown), in which the wings 8 of the end 7*b* are closed, then through a marking station (not shown), in which a code is affixed to the flap 9 of the end 7*b*, and finally, through a second closing station (not shown), in which the flap 9 of the end 7*b*, and subsequently the end 7*b*, are closed.

Afterwards, the unit 28 is fed to the transferring station 16, in step relation with a pocket 52 of the pocket filling conveyor 17.

Figure 6:
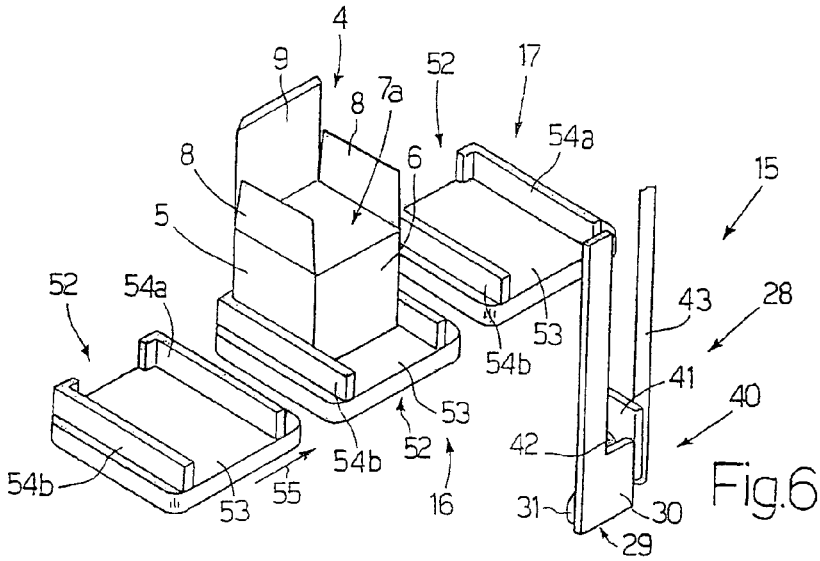

When in the station 16, the wall 54*a* is moved by the actuator 57 to its second working position, against the action of the spring 56, and the unit 28 moves again to its withdrawn position, to release the box 4 in its final erected configuration and with the end 7*b* closed, into the pocket 52 in question (FIG. 6).

According to FIG. 1, when the box 4 has been positioned inside the pocket 52, the actuator 57 is deactivated to allow the walls 54*a* and 54*b* to assume a position, in which the box 4 is tightened therebetween, the unit 28 is moved to its rear position to disengage the box 4, and the box 4 is fed by the conveyor 17, first through a succession of filling stations 60 of known type, to introduce, into the box 4, for example an article 61 and an information leaflet 62, then through a first closing station 63, in which the wings 8 of the end 7*a* are closed, and finally, through a second closing station 64, in which the flap 9 of the end 7*a* and then the end 7*a*, are closed.

The boxing machine 1 presents some advantages, deriving mainly from the fact that the boxes 4 are withdrawn from the magazine 2 by the suction cups 20 and then they are transferred by the suction cups 31 and 42, which keep the boxes 4 without releasing them during the steps of erecting, marking of the flaps 9 of the relative ends 7*b*, closing the ends 7*b* and of introducing into the relative pockets 52.

Moreover, the boxing machine 1 presents another advantage deriving from the fact that the pockets 52 of variable width allow the operator to avoid the equipping the pockets 52 in function of the size of the boxes 4, used each time.

Moreover, the conformation of the conveying and erecting units 28 and of the pockets 52 allows to avoid scratches and/or damages of any type to the boxes 4.

Obviously, both the conveying and erecting device 15 and the pocket filling conveyor 17 can be installed in a boxing machine operated in a continuous way.

What is claimed is:

1. A boxing machine for erecting and filling boxes, each box being erected from an initial flattened configuration where each box is arranged in two overlapped layers, each layer of said overlapped layers defining at least one wall of the box, the boxing machine comprising:

a magazine for containing at least one box in a flattened configuration;

erecting and conveying means for picking up the box in the flattened configuration from the magazine, and for erecting the box into an erected configuration, in which the box has a parallelogram section, the erecting and conveying means conveying the erected box to a transferring station;

a pocket conveyor having a belt and located at the transferring station and having at least one pocket for receiving the erected box mounted thereto, said pocket including a bottom wall attached to the belt and two lateral walls substantially orthogonal to the bottom wall, at least one lateral wall being slidably coupled to the bottom wall and movable with respect to the other lateral wall by pushing means carried by said pocket, so that the width of the pocket can be varied, the lateral walls movement being controlled by actuating means comprising a control bar protruding from the at least one lateral wall and engaged slidingly within a slot in the bottom wall and belt, the at least one lateral wall being moved by said actuating means from a first working position in which the lateral walls are at a distance from each other approximating a minimum box width, to a box receiving position where the lateral walls are spaced away from each other to a maximum width which exceeds a maximum box width such that the erected box can be received in the pocket, and then after the box is received, the lateral walls are moved to a box tightening position where the lateral walls are spaced closer to each other so that the erected box is engaged by the walls and held within the pocket, the lateral walls being normally kept in said first working position by said pushing means;

the actuating means provided in said transferring station and being movable between a raised working position, in which the actuating means are operable to engage with the at least one of the lateral walls of the pocket to move the at least one lateral wall against the action of said pushing means, from said first working position to said box receiving position to allow introducing an erected box into the pocket, and a lowered rest position, where the actuating means are arranged to allow the at least one lateral wall to be moved back by said pushing means to the box tightening position for engaging and holding the box, thereafter the pocket remains in the box tightening position as the pocket holding the box is moved by the pocket conveyor means to a filling station, and, filling means for introducing at least one article into the box held in the box tightening position.

2. A boxing machine as claimed in claim 1, wherein the lateral walls of the pocket have a range of movement controlled by said actuating means.

3. A boxing machine as claimed in claim 1, wherein the pocket conveyor moves said pocket, in steps, through the transferring station and the erecting and conveying means moves said box in steps along a path extending between the magazine and the transferring station.

4. A boxing machine as claimed in claim 3, further comprising a withdrawing device for transferring the box from the magazine to the erecting and conveying means.

5. A boxing machine for erecting and filling boxes, each box being erected from an initial flattened configuration where each box is arranged in two overlapped layers, each layer of said overlapped layers defining at least one wall of the box, the boxing machine comprising:

a magazine for containing at least one box in a flattened configuration;

erecting and conveying means for picking up the box in the flattened configuration from the magazine, and for erecting the box into an erected configuration, in which the box has a parallelogram section, the erecting and conveying means conveying the erected box to a transferring station;

a pocket conveyor located at the transferring station and having at least one pocket for receiving the erected box, said pocket conveyor including a belt, each pocket including a bottom wall fastened to the belt and two lateral walls substantially orthogonal to the bottom wall, a first lateral wall being integral with the bottom wall, a second lateral wall being coupled slidingly with the bottom wall so as to move with respect to the first lateral wall by pushing means carried by said pocket, to vary a width of the pocket, the second lateral wall moved from a first working position in which the lateral walls are at a distance from each other approximating a minimum box width, to a box receiving position where the lateral walls are spaced away from each other to a maximum width which exceeds a maximum box width such that the erected box can be received in the pocket, and then after the box is received, the lateral walls are moved to a box tightening position where the lateral walls are spaced closer to each other so that the erected box is engaged by the lateral walls and held within the pocket, the lateral walls being normally kept in said first working position by said pushing means;

actuating means provided in said transferring station and being movable between a raised working position, in which the actuating means are operable to engage with the second lateral wall of the pocket to move the second lateral wall against the action of said pushing means, from said first working position to said box receiving position to allow introducing an erected box into the pocket, and a lowered rest position, where the actuating means are arranged to allow the lateral walls to be moved back by said pushing means to the box tightening position for engaging and holding the box, the actuator means engaging a control bar which protrudes from the second lateral wall, the control bar engaged slidingly within a slot provided in the bottom wall and the belt, such that when the actuator means move to the raised position, the actuator means push the bar in the slot to move the second lateral wall against the action of the pushing means away from the first lateral wall to the second working position, and when the actuator means move to the lowered position, the bar is disengaged, and the pushing means move the second lateral wall to the box tightening position, thereafter, the pocket remains in the box tightening position engaged to the box as the pocket is moved by the pocket conveyor means to a filling station, and, filling means for introducing at least one article into the box held in the box tightening position.

* * * * *